US010233588B2

(12) United States Patent
Yagi

(10) Patent No.: US 10,233,588 B2
(45) Date of Patent: Mar. 19, 2019

(54) STEAM IRON

(71) Applicant: Panasonic Intellectual Property Management Co., Ltd., Osaka (JP)

(72) Inventor: Toyohiko Yagi, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 38 days.

(21) Appl. No.: 15/500,386

(22) PCT Filed: Aug. 17, 2015

(86) PCT No.: PCT/JP2015/004067
§ 371 (c)(1),
(2) Date: Apr. 25, 2017

(87) PCT Pub. No.: WO2016/038792
PCT Pub. Date: Mar. 17, 2016

(65) Prior Publication Data

US 2017/0226687 A1 Aug. 10, 2017

(30) Foreign Application Priority Data

Sep. 11, 2014 (JP) ..... 2014-184956

(51) Int. Cl.
*D06F 75/24* (2006.01)
*D06F 75/18* (2006.01)
*D06F 75/38* (2006.01)

(52) U.S. Cl.
CPC ..... *D06F 75/24* (2013.01); *D06F 75/18* (2013.01); *D06F 75/38* (2013.01)

(58) Field of Classification Search
CPC ..... D06F 75/00–75/24; D06F 75/36; D06F 75/38
See application file for complete search history.

(56) References Cited

U.S. PATENT DOCUMENTS 1,385,646 A * 7/1921 Rubenstein ..... D06F 75/06 38/77.6
2,160,421 A * 5/1939 Sebo ..... D06F 75/12 38/77.6

(Continued)

FOREIGN PATENT DOCUMENTS

FR 2815649 A1 4/2002
JP 57-094498 6/1982

(Continued)

OTHER PUBLICATIONS

The Extended European Search Report dated Jul. 26, 2017 for the related European Patent Application No. 15840593.6.

(Continued)

*Primary Examiner* — Ismael Izaguirre
(74) *Attorney, Agent, or Firm* — McDermott Will & Emery LLP

(57) ABSTRACT

A steam iron includes: a heating body having a heater; a vaporizing chamber on an upper surface side of the heating body; and a lid covering the upper surface side of the heating body. The steam iron further includes: a base on a lower surface side of the heating body; a steam jet hole provided in the base; and a steam passage for guiding the steam generated by the vaporizing chamber to the steam jet hole. The steam passage has a first heating passage and a second heating passage on the upper surface side of the heating body, and a heating chamber and a base passage on the lower surface side of the heating body. The steam passage guides the steam after passing through the heating chamber to the base passage via the second heating passage so that the steam is jetted from the steam jet hole.

7 Claims, 10 Drawing Sheets

(56) References Cited

U.S. PATENT DOCUMENTS

| | | | | | |
|---|---|---|---|---|---|
| 2,499,184 | A | * | 2/1950 | Finlayson | D06F 75/18 38/77.81 |
| 2,793,448 | A | * | 5/1957 | Duncanson | D06F 75/16 38/77.83 |
| 3,110,975 | A | * | 11/1963 | Kircher | D06F 75/18 38/77.7 |
| 5,279,054 | A | * | 1/1994 | Chasen | D06F 75/24 219/254 |
| 5,279,055 | A | * | 1/1994 | Eckert | D06F 75/18 219/254 |
| 5,388,180 | A | * | 2/1995 | Bayles | B44C 7/027 392/396 |
| 5,979,089 | A | | 11/1999 | Bouleau et al. | |
| 2004/0025382 | A1 | | 2/2004 | Walther | |

FOREIGN PATENT DOCUMENTS

| | | |
|---|---|---|
| JP | 5-009495 | 1/1993 |
| JP | 2000-107498 | 4/2000 |
| JP | 2002-166100 | 6/2002 |
| JP | 2004-129921 | 4/2004 |
| JP | 2008-093087 | 4/2008 |
| WO | 1997/017487 A1 | 5/1997 |

OTHER PUBLICATIONS

International Search Report of PCT application No. PCT/JP2015/004067 dated Nov. 17, 2015.

* cited by examiner

STEAM IRON

TECHNICAL FIELD

The present disclosure relates to a steam iron used for wrinkle smoothing of textile goods including clothing (hereinafter, simply referred to as clothing or the like).

BACKGROUND ART

A conventional steam iron has a base provided with an ironing surface and a vaporizing chamber, and a heater that is integrally incorporated in the base and heats the base. The base has the vaporizing chamber for steam generation provided on an upper surface side of the base, and the ironing surface provided on a lower surface side of the base. A temperature of the base is adjustable, for example, in a range from 80° C. to 200° C., in accordance with clothing or the like that is an object to be ironed.

The steam iron has a "steam-ironing mode" for ironing with steam, and a "dry-ironing mode" for ironing without steam.

In a case of the dry-ironing mode, a reduction in the temperature of the base in ironing is small, and the ironing surface can be easily maintained at a set temperature by electric conduction control of the heater. On the other hand, in a case of the steam-ironing mode, heat is lost due to vaporization of water to be supplied to the vaporizing chamber, and the ironing surface is cooled by clothing or the like containing condensed water from jetted steam, so that the temperature of the base is reduced.

Vaporization capability depends on a temperature. When the vaporizing chamber is made to have a high temperature, the vaporization capability is improved, and a large amount of steam is generated. At a low temperature, the vaporization capability is lowered, and an amount of generated steam is reduced. When the temperature of the vaporizing chamber is increased, a temperature of the ironing surface provided in the base also increases. When the temperature of the ironing surface is reduced, the temperature of the vaporizing chamber provided in the base also reduces.

Accordingly, when the ironing surface is set to a low temperature suitable for chemical fibers weak against heat, the temperature of the vaporizing chamber reduces, and the amount of steam reduces, so that ironing in the steam-ironing mode becomes difficult.

In order to solve this problem, applications for the following prior techniques are filed.

PTL 1 discloses a steam iron that includes a vaporizing chamber having a heater, and a heat sensing unit for temperature control, and is provided above a base with a space, and that properly controls a temperature of the vaporizing chamber without being affected by the temperature of the base.

PTL 2 discloses a steam iron that includes a base and a vaporizing chamber, each of which is provided with a heater and a temperature detector, and that controls a temperature of an ironing surface and a steam amount in accordance with clothing or the like.

PTL 3 discloses a steam iron that has a first base provided with a vaporizing chamber, and a second base provided with an ironing surface, and is provided with a thermally resistive layer being an air layer separated by an outer peripheral rib and a steam rib between the first base and the second base. In this conventional technique, a temperature of the first base is set to be high, the thermally resistive layer is used as a steam staying layer, and steam is jetted after heat is discharged by the second base.

PTL 4 discloses a steam iron that is provided with an ironing surface on a lower surface side of a vaporizing chamber heated by a heater, with a heat insulation part interposed between the ironing surface and the vaporizing chamber, and that controls supply of heat from the vaporizing chamber to the ironing surface to jet steam while maintaining the ironing surface at a low temperature.

PTL 5 discloses a steam iron that has a lid for covering an upper surface side of a first base provided with a vaporizing chamber, and a space part provided with an ironing surface member on a lower surface side, and that jets steam generated by the vaporizing chamber through the space part.

PTL 6 discloses a steam iron that has a base provided with a vaporizing chamber, and a steam passage provided on an upper surface side of the base and provided with a labyrinth, and that jets steam from steam holes of an ironing surface via the labyrinth.

However, when an ironing surface is set to a low temperature suitable for clothing or the like, the steam amount reduces by considerable lowering of vaporization capability, and a favorable wrinkle smoothing effect by steam is not obtained. When a water supply amount to a vaporizing chamber is increased in order to increase the steam amount, since vaporization capability is insufficient, steam containing water droplets which are not vaporized is jetted, so that clothing or the like is moistened.

Therefore, even in a case where the ironing surface is set to a low temperature, the vaporizing chamber is heated up to a temperature suitable for generation of steam, so that it is possible to jet a proper amount of steam in accordance with the vaporization capability from the low-temperature ironing surface to attain ironing.

However, in order to iron chemical fibers or the like, for example, in a case of an iron configured such that a temperature of an ironing surface can be set to 130° C., for example, when the vaporizing chamber is heated to 160° C. being a temperature suitable for generation of steam, the following problems occur.

In such an iron, when the vaporizing chamber is heated up to a predetermined temperature by electric conduction, the electric conduction to the heater is stopped by a thermostat. However, after the stop of the electric conduction, the temperature of the vaporizing chamber continues to increase, and exceeds the predetermined temperature.

On the other hand, heat conduction from the vaporizing chamber is restricted such that a desirable temperature difference is generated between the ironing surface set to a low temperature and the vaporizing chamber heated to a high temperature, and therefore the temperature of the ironing surface increases later than the temperature of the vaporizing chamber.

Generally, when electric conduction to the heater is stopped by the thermostat, an iron is in a usable state. However, as for a temperature of the base at a start of use, while the temperature of the vaporizing chamber exceeds a predetermined temperature, the temperature of the ironing surface is slightly lower than a desirable temperature.

Accordingly, although steam generated by the high-temperature vaporizing chamber is steam generated by proper vaporization capability, the steam being in a favorable state where water droplets are not contained, there is a possibility that the steam is cooled when jetted from the low-temperature ironing surface, and dew condensation water is mixed in steam to be jetted.

Additionally, in a case where a space or the like is provided between the vaporizing chamber and the base to keep the temperature of the base at a desirable low temperature, it takes time until the temperature of the base increases to a temperature suitable for ironing.

CITATION LIST

Patent Literature

PTL 1: Unexamined Japanese Utility Model Publication No. S57-094498

PTL 2: Unexamined Japanese Utility Model Publication No. H05-009495

PTL 3: Unexamined Japanese Patent Publication No. 2000-107498

PTL 4: Unexamined Japanese Patent Publication No. 2002-166100

PTL 5: Unexamined Japanese Patent Publication No. 2004-129921

PTL 6: Unexamined Japanese Patent Publication No. 2008-093087

SUMMARY OF THE INVENTION

The present disclosure solves the above conventional problems, and an object of the present disclosure is to provide a steam iron that heats a base in a short time, and allows ironing with steam in a favorable state where water droplets are not contained even in a case where the base is set to a low temperature.

In order to solve the above conventional problems, a steam iron according to an aspect of the present disclosure includes: a heating body having a heater; a vaporizing chamber that is provided on an upper surface side of the heating body, and generates steam; a lid for covering the upper surface side of the heating body; a base provided on a lower surface side of the heating body; a steam jet hole provided in the base; and a steam passage for guiding the steam generated by the vaporizing chamber to the steam jet hole.

The steam passage has a heating passage provided on the upper surface side of the heating body, and a heating chamber and a base passage which are provided on the lower surface side of the heating body. The steam passage is configured to guide the steam after passing through the heating chamber to the base passage via the heating passage so that the steam is jetted from the steam jet hole.

According to the present aspect, when the steam generated by the vaporizing chamber passes through the heating chamber, a temperature of the base is rapidly increased. As a result, in the steam iron according to the present aspect, it is possible to iron with steam in a favorable state where water droplets are not contained even in a case where the base is set to a low temperature.

DETAILED DESCRIPTION OF THE PREFERRED EMBODIMENTS

Figure 1:
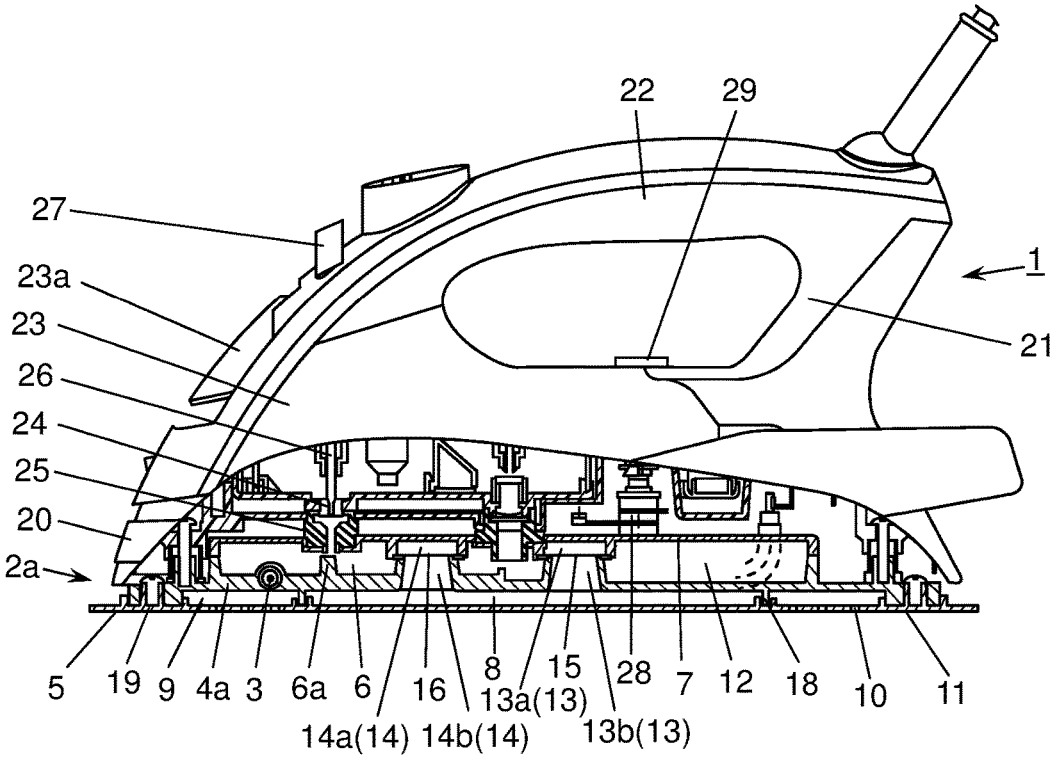
FIG. 1 is a cutaway longitudinal sectional view of a steam iron according to a first exemplary embodiment of the present disclosure.

A steam iron according to a first aspect of the present disclosure includes: a heating body having a heater; a vaporizing chamber provided on an upper surface side of the heating body for generating steam; a lid for covering the upper surface side of the heating body; a base provided on a lower surface side of the heating body; a steam jet hole provided in the base; and a steam passage for guiding the steam generated by the vaporizing chamber to the steam jet hole.

The steam passage has a heating passage provided on the upper surface side of the heating body, and a heating chamber and a base passage provided on the lower surface side of the heating body. The steam passage is configured to guide the steam after passing through the heating chamber to the base passage via the heating passage so that the steam is jetted from the steam jet hole.

According to the present aspect, when passing through the heating chamber, the steam generated by the vaporizing chamber heats the base. Therefore, a temperature of the base rapidly increases, and generation of dew condensation is prevented. As a result, it is possible to iron with steam in a favorable state where water droplets are not contained even in a case where the base is set to a low temperature.

In a steam iron according to a second aspect of the present disclosure, the heating chamber is provided between the heating body and the base, and is provided below the vaporizing chamber. According to the present aspect, when passing through the heating chamber, the steam is heated by the high-temperature vaporizing chamber, and therefore a temperature reduction of the steam can be suppressed.

In a steam iron according to a third aspect of the present disclosure, the heating chamber has an elongated shape in a longitudinal direction of the base. According to the present aspect, the heating chamber heats the base in a wider range, and therefore heating of the base is promoted.

In a steam iron according to a fourth aspect of the present disclosure, the base passage is provided along an outer periphery of the heating chamber. According to the present aspect, steam jet holes are dispersedly provided in a wider range, and a wrinkle smoothing effect is enhanced.

A steam iron according to a fifth aspect of the present disclosure further includes a partitioning plate provided between the heating body and the lid, and, in this steam iron, the heating passage has a partitioned passage provided along the partitioning plate, and a communicating part that vertically penetrates the heating body. According to the present aspect, a longer steam passage along the heating body is provided in a limited space. Consequently, vaporization can be promoted.

A steam iron according to a sixth aspect of the present disclosure further includes a first partitioning plate and a second partitioning plate provided between the heating body and the lid. The partitioned passage has a first partitioned passage provided along the first partitioning plate, and a second partitioned passage provided along the second partitioning plate. The communicating part has a first communicating part that communicates the first partitioned passage with the heating chamber, a second communicating part that communicates the heating chamber with the second partitioned passage, and a third communicating part that communicates the second partitioned passage with the base passage.

According to the present aspect, the steam passage is provided along the top, bottom, right and left of the heating body, so that the steam passage has a longer route in a limited space. The steam from the vaporizing chamber is heated by the heating body when passing through the steam passage, and vaporization is promoted.

In a steam iron according to a seventh aspect of the present disclosure, the base and the heating body are sealed with a first sealing part provided along an outer periphery of the base passage, and a second sealing part provided along the outer periphery of the heating chamber and an inner periphery of the base passage. According to the present aspect, it is possible to reliably prevent leakage of steam or water droplets. Furthermore, heat conduction from the heating body to the base is absorbed, and the base can be set to a low temperature even when the heating body is set to a high temperature suitable for vaporization.

In a steam iron according to an eighth aspect of the present disclosure, the heater has a substantially U-shaped curved part, and the vaporizing chamber is provided on an inside and an outside of the curved part. According to the present aspect, it is possible to efficiently heat the vaporizing chamber by a part, having a large heat capacity, of the heater to enhance vaporization capability. Additionally, it is possible to efficiently generate a large amount of steam.

In a steam iron according to a ninth aspect of the present disclosure, the lid is formed of a thin plate. According to the present aspect, processing of the lid can be facilitated.

A steam iron according to a tenth aspect of the present disclosure further includes an auxiliary heating plate provided in the base passage and below the third communicating part. The auxiliary heating plate is thermally connected to the heating body.

According to the present aspect, it is possible to further suppress a possibility that dew condensation water is mixed in the steam jetted from the steam jet hole. As a result, it is possible to iron with steam in a favorable state where water droplets are not contained even in a case where the base is set to a low temperature.

Hereinafter, exemplary embodiments of the present disclosure are described with reference to the drawings.

First Exemplary Embodiment

Figure 2:
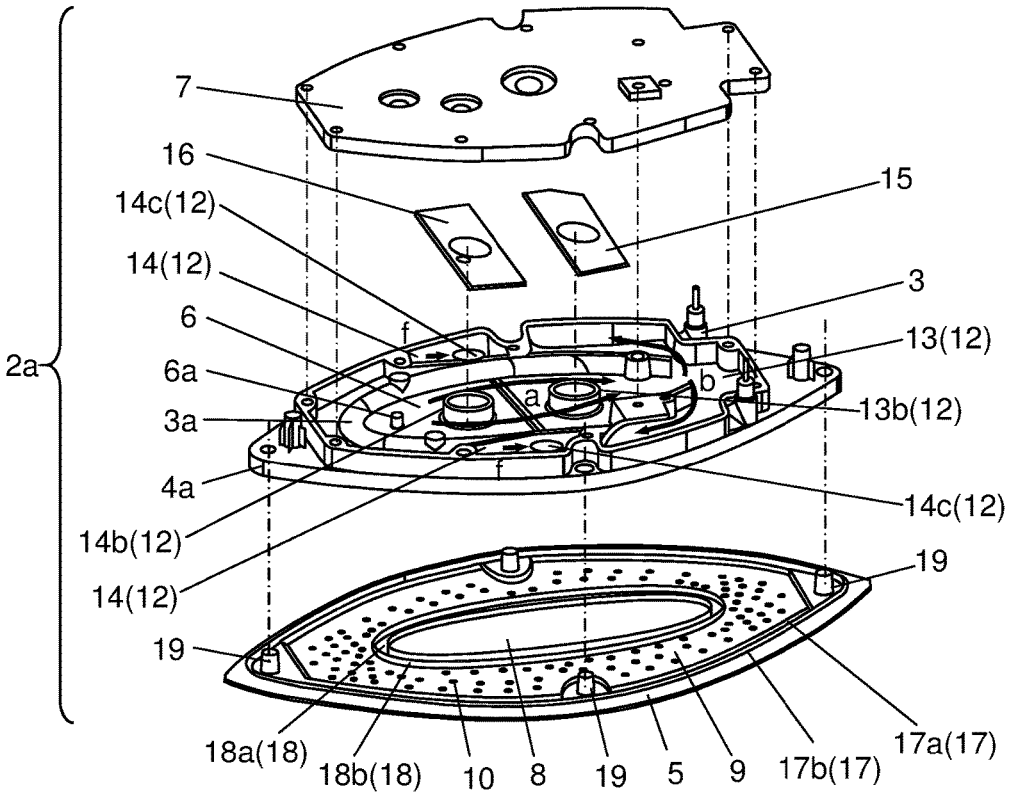
FIG. 2 is an exploded perspective view of a case where a base part according to the first exemplary embodiment is obliquely viewed from above.
Figure 3:
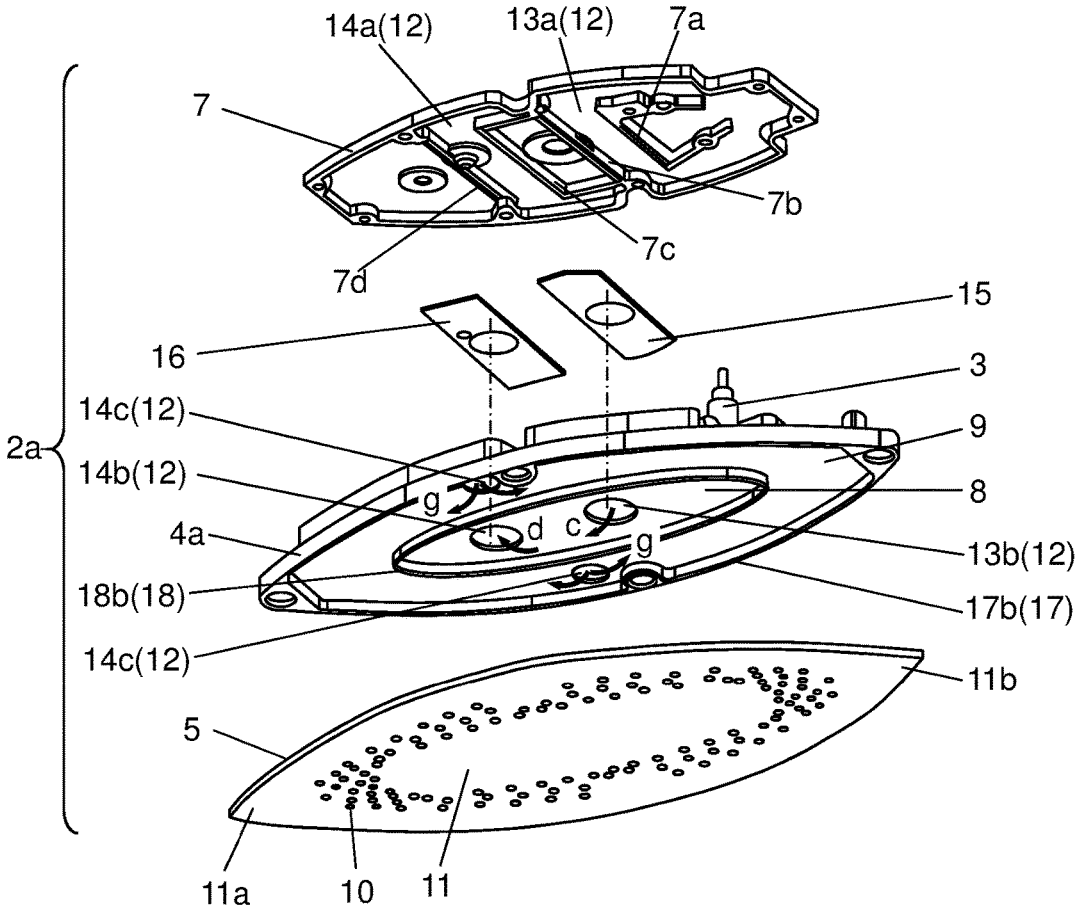
FIG. 3 is an exploded perspective view of a case where the base part according to the first exemplary embodiment is obliquely viewed from below.
Figure 4:
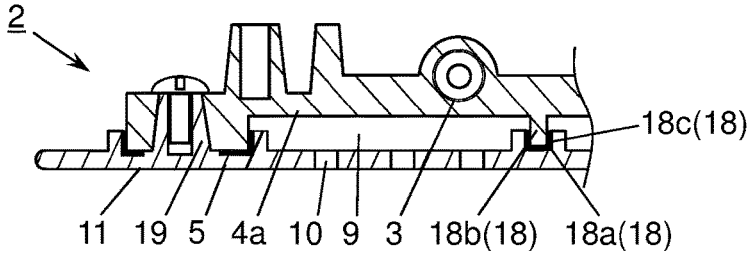
FIG. 4 is a longitudinal sectional view of a front part of the base part according to the first exemplary embodiment.
Figure 5:
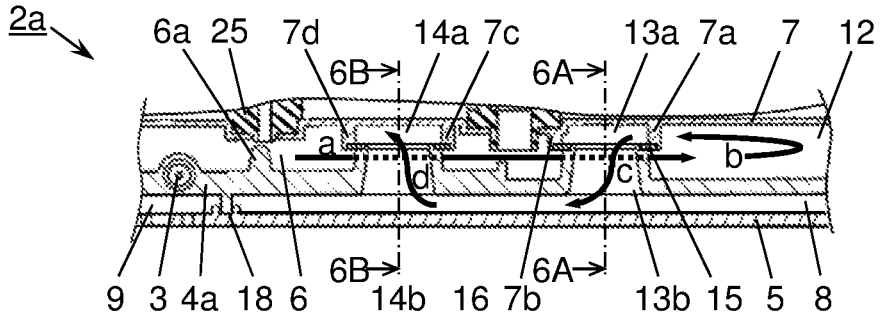
FIG. 5 is a longitudinal sectional view of a central part of the base part according to the exemplary embodiment.
Figure 6A:
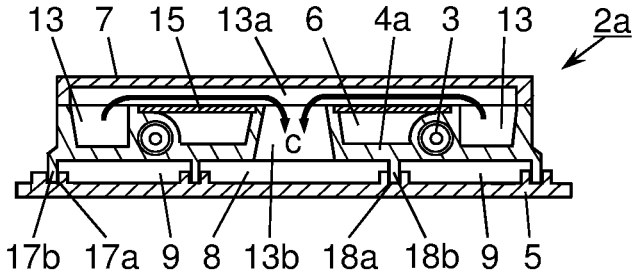
FIG. 6A is a sectional view taken along line 6A-6A in FIG. 5.
Figure 6B:
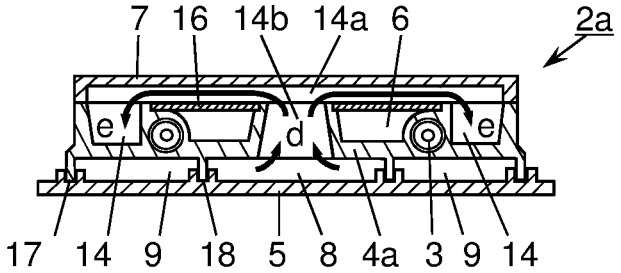
FIG. 6B is a sectional view taken along line 6B-6B in FIG. 5.

FIG. 1 is a cutaway longitudinal sectional view of steam iron 1 according to a first exemplary embodiment of the present disclosure. FIG. 2 is an exploded perspective view of a case where base part 2*a* of steam iron 1 is obliquely viewed from above. FIG. 3 is an exploded perspective view of a case where base part 2*a* is obliquely viewed from below. FIG. 4 is a longitudinal sectional view of a principal part of a front part of base part 2*a*. FIG. 5 is a longitudinal sectional view of a principal part of a central part of base part 2*a*. FIG. 6A is a sectional view taken along line 6A-6A in FIG. 5, and FIG. 6B is a sectional view taken along line 6B-6B in FIG. 5.

As illustrated in FIG. 1 to FIG. 4, steam iron 1 includes base part 2*a* that jets steam to clothing or the like. Base part 2*a* has heating body 4*a* integrally provided with heater 3, lid 7 provided so as to cover an upper surface side of heating body 4*a*, and base 5 provided so as to cover a lower surface side of heating body 4*a*.

Heating body 4*a* has buried heater 3 molded from good heat conductive aluminum. Heater 3 is composed of a sheathed heater or the like, and has substantially U-shaped curved part 3*a*.

On an upper surface side of heating body 4*a*, vaporizing chamber 6 for steam generation is formed. Vaporizing chamber 6 is formed on a front part of heating body 4*a* so as to communicate an inner part of curved part 3*a* of heater 3 with an outer part thereof. Consequently, it is possible to efficiently heat the vaporizing chamber by a part, having a large heat capacity, of the heater to enhance vaporization capability. As a result, it is possible to efficiently generate a large amount of steam.

On the upper surface side of heating body 4*a*, lid 7 molded from good heat conductive aluminum is provided by seal-bonding. Between heating body 4*a* and lid 7, vaporizing chamber 6 and later-described heating passages are formed. On a lower surface of lid 7, ledge 7*a*, ledge 7*b*, ledge 7*c*, and ledge 7*d* for defining the later-described heating passages are formed.

Base 5 is molded from good heat conductive aluminum, and is coupled to heating body 4*a*. A coupling part between heating body 4*a* and base 5 is sealed with a seal material such as silicon resin. This seal material absorbs heat conduction from heating body 4*a* to base 5.

Between heating body 4*a* and base 5, heating chamber 8 and base passage 9 are formed. Heating chamber 8 is provided below vaporizing chamber 6. Therefore, when passing through heating chamber 8, steam is heated by high-temperature vaporizing chamber 6, so that a temperature reduction of the steam can be suppressed.

Heating chamber 8 has a longitudinally elongated oval shape, and is formed at a center of base 5. Heating chamber 8 thus formed in a wide range can efficiently heat base 5 in a wider range.

Base passage 9 is formed along an outer periphery of heating chamber 8 so as to surround heating chamber 8. In base 5, a large number of steam jet holes 10 are dispersedly provided in order to enhance a wrinkle smoothing effect. A lower surface of base 5 is processed to become harder and easily slide, and functions as ironing surface 11 for pressing clothing or the like.

Front part 11*a* and back part 11*b* of ironing surface 11 each have a substantially pointed shape such that steam iron 1 smoothly moves forward and backward on clothing or the like.

Steam generated by vaporizing chamber 6 is jetted from steam jet holes 10 through steam passage 12. Steam passage 12 has first heating passage 13 and second heating passage 14 that are heating passages formed on the upper surface side of heating body 4*a*, and heating chamber 8 and base passage 9 that are formed on a lower surface side of heating body 4*a*.

That is, steam passage 12 is a general term of a whole route through which the steam generated by vaporizing chamber 6 passes before jetting from steam jet holes 10.

First heating passage 13 and second heating passage 14 extend along right and left peripheral edges of heating body 4*a*. First heating passage 13 is formed at a back of heating body 4*a*, and second heating passage 14 is formed at a front of first heating passage 13.

First heating passage 13 has first partitioning plate 15 made of aluminum and provided between heating body 4*a* and lid 7, and first partitioned passage 13*a* defined by ledge 7*a*, ledge 7*b* and first partitioning plate 15 along an upper surface of first partitioning plate 15. First heating passage 13 further has first communicating part 13*b* that is located at a slightly back of a center of heating body 4*a*, and vertically penetrates heating body 4*a* to communicate first partitioned passage 13*a* with heating chamber 8.

Second heating passage 14 has second partitioning plate 16 made of aluminum and provided between heating body 4*a* and lid 7, and second partitioned passage 14*a* defined by ledge 7*c*, ledge 7*d* and second partitioning plate 16 along an upper surface of second partitioning plate 16. Second heating passage 14 further has second communicating part 14*b* that is located at a slightly front of the center of heating body 4*a*, and vertically penetrates heating body 4*a* to communicate heating chamber 8 with second partitioned passage 14*a*.

Second heating passage 14 is provided with communication hole 14*c* that is a third communicating part which vertically penetrates heating body 4*a* to communicate second partitioned passage 14*a* with base passage 9.

First partitioning plate 15 and second partitioning plate 16 function as partitioning plates, and first communicating part 13*b*, second communicating part 14*b*, and communication hole 14*c* function as communicating parts.

The steam generated by vaporizing chamber 6 flows backward through below second partitioning plate 16 and first partitioning plate 15. First partitioned passage 13*a* and second partitioned passage 14*a* are provided above first partitioning plate 15 and second partitioning plate 16, respectively.

First partitioned passage 13*a*, second partitioned passage 14*a*, first communicating part 13*b*, second communicating part 14*b*, and communication hole 14*c* are configured so as to three-dimensionally surround vaporizing chamber 6. That is, steam passage 12 has a three dimensional structure along an upper side, a lower side, a left side, and a right side of heating body 4*a*.

With this structure, steam passage 12 having a longer route is formed in a limited space. When passing through steam passage 12, the steam generated by vaporizing chamber 6 is heated for a longer time, and therefore vaporization is promoted.

A plurality of (four in this exemplary embodiment) fixing parts 19 firmly couple heating body 4*a* with base 5. First sealing part 17 and second sealing part 18 seal the coupling part between heating body 4*a* and base 5.

First sealing part 17 includes groove 17*a*, protrusion 17*b*, and a seal material (not illustrated). Groove 17*a* is provided on an upper surface of base 5 along an outer periphery of base 5. Protrusion 17*b* is provided on a lower surface of heating body 4*a* along an outer periphery of heating body 4*a*. Protrusion 17*b* is inserted into groove 17*a*, and the seal material (not illustrated) is filled in a clearance at a fitting part between protrusion 17*b* and groove 17*a*, so that first sealing part 17 is formed.

Second sealing part 18 includes groove 18*a*, protrusion 18*b*, and seal material 18*c* (see FIG. 4). Groove 18*a* is provided on the upper surface of base 5 and on an inside of groove 17*a*. Protrusion 18*b* is provided on the lower surface of heating body 4*a* and on an inside of protrusion 17*b*. Protrusion 18*b* is inserted into groove 18*a*, and seal material 18*c* is filled in a clearance at a fitting part between protrusion 18*b* and groove 18*a*, so that second sealing part 18 is formed.

First sealing part 17 and second sealing part 18 can reliably prevent leakage of steam and water droplets. Furthermore, heating chamber 8 absorbs heat conduction from heating body 4*a* to base 5.

On the upper surface side of heating body 4*a*, heat insulator 20 (see FIG. 1) that covers an almost whole area of the upper surface is provided. Heat insulator 20 is formed of a heat-resistant PBT (polybutylene terephthalate) resin molded article. Handle 21 is formed of a PP (polypropylene) resin molded article, and is provided above heat insulator 20. Grip 22 that horizontally extends is integrally provided on an upper part of handle 21 (see FIG. 1).

Water tank 23 is provided at a front part of handle 21, and stores water to be supplied to vaporizing chamber 6. On a front surface of water tank 23, water injection port lid 23*a* that openably closes a water injection port (not illustrated) is provided. Water stored in water tank 23 drops in vaporizing chamber 6 from nozzle 24 provided in a bottom of water tank 23. Nozzle 24 communicates with vaporizing chamber 6 through nozzle packing 25 formed of heat-resistant silicone rubber or the like.

Vaporizing chamber 6 is provided with projecting dropping part 6*a* facing nozzle 24. Water that drops in dropping part 6*a* during heating of vaporizing chamber 6 by heater 3 is instantaneously vaporized near curved part 3*a*.

Supply and stop of water to vaporizing chamber 6 is performed by vertical movement of openable rod 26 that openably closes nozzle 24. The vertical movement of openable rod 26 is performed by manual operation of operation button 27 provided at a front of grip 22 (see FIG. 1).

When nozzle 24 is closed with descent of openable rod 26, the steam iron is brought into a state of a dry-ironing mode in which water does not drop in vaporizing chamber 6 and steam does not jet. On the other hand, when nozzle 24 is opened with ascent of openable rod 26, the steam iron is brought into a state of a steam-ironing mode in which water drops in vaporizing chamber 6 and steam jets.

Operation button 27 is provided so as to be rotatable right and left. Rotary motion of operation button 27 by a user is transmitted to openable rod 26 through a cam (not illustrated), and openable rod 26 vertically moves. Thus, the dry-ironing mode and the steam-ironing mode are switched by operation of operation button 27.

Thermostat 28 is mounted on an upper part of heating body 4*a*, and turns on and off electric conduction to heater 3 in accordance with a temperature of heating body 4*a* to control heating body 4*a* at a predetermined temperature (e.g., 160° C.). Power switch 29 is provided in handle 21, and turns on and off electric conduction to a heater circuit of steam iron 1.

Operation and action of steam iron 1 configured as described above are hereinafter described.

In order to use steam iron 1, after pouring water in water tank 23 from the water injection port, water injection port lid 23*a* of which is open, a user turns on power switch 29. When power switch 29 is turned on and electric conduction to the heater circuit is started, thermostat 28 controls electric conduction of heater 3, and heating body 4*a* is heated to a preset temperature.

After heating body 4*a* is heated to the preset temperature, when openable rod 26 ascends and nozzle 24 is opened in accordance with operation of operation button 27 by the user, water in water tank 23 drops in vaporizing chamber 6, and steam is generated. The generated steam jets from steam jet holes 10 through steam passage 12. When operation button 27 is operated and nozzle 24 is closed, the jetting of steam is stopped. Thus, it is possible to change setting from the steam-ironing mode to the dry-ironing mode during ironing.

Now, in a case where ironing in the steam-ironing mode is performed, a flow of steam from generation by vaporizing chamber 6 to jetting from steam jet holes 10 is described.

In FIG. 2, when water in water tank 23 drops in dropping part 6*a* of vaporizing chamber 6 from nozzle 24, the water is vaporized to become steam. The steam generated by vaporizing chamber 6 flows backward, namely, in a direction of arrow a, through an outside of second communicating part 14*b* and a lower side of second partitioning plate 16, and an outside of first communicating part 13*b* and a lower side of first partitioning plate 15.

The steam that has reached first heating passage 13 from vaporizing chamber 6 changes a flowing direction along a shape of first heating passage 13 to flow forward, as illustrated by arrows b in FIG. 2 and FIG. 5.

As illustrated by arrows c in FIG. 3, FIG. 5 and FIG. 6A, the steam flows from both right and left sides of first partitioned passage 13*a* toward a center, and flows through first communicating part 13*b* downward to reach heating chamber 8. As illustrated by arrows d in FIG. 3, FIG. 5 and FIG. 6B, the steam flows from heating chamber 8, and flows through second communicating part 14*b* upward to reach second partitioned passage 14*a*. As illustrated by arrows e in FIG. 6B, the steam flows from the center toward both right and left sides of second partitioned passage 14*a*, and reaches a front part of second heating passage 14 formed on the upper surface side of heating body 4*a*.

As illustrated by arrow f in FIG. 2, the steam flows through second heating passage 14 backward. As illustrated by arrows g in FIG. 3, the steam flows into base passage 9 from communication hole 14*c* provided at a back part of second heating passage 14, and jets from steam jet holes 10 outside steam iron 1.

Figure 7:
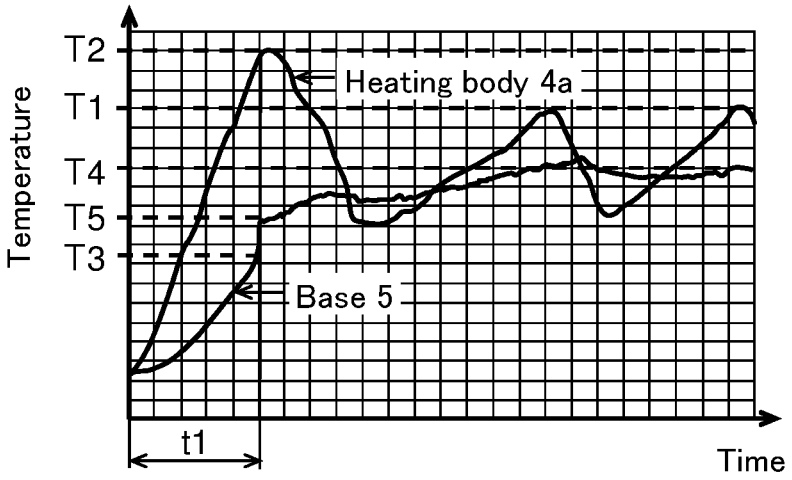
FIG. 7 is a graph illustrating temperature changes of a heating body and a base according to the first exemplary embodiment.

Now, a temperature of base part 2*a* in a case where ironing in the steam-ironing mode is performed is described. FIG. 7 is a graph illustrating temperature changes of heating body 4*a* and base 5 from a start of electric conduction of heater 3. As illustrated in FIG. 7, when heater 3 is electrically conducted, a temperature of heating body 4*a* increases. When heating body 4*a* is heated to predetermined temperature T1 (e.g., 160° C.), electric conduction to heater 3 is stopped by operation of thermostat 28.

The temperature of heating body 4*a* continues to increase after the stop of electric conduction to heater 3, and reaches temperature T2 (e.g., 190° C.). On the other hand, heat conduction from heating body 4*a* is restricted, and therefore a temperature of base 5 increases later than the temperature of heating body 4*a*.

Startup time t1 from the start of electrical conduction to a time when steam is usable is, for example, about 50 seconds. At this time, temperature T3 (e.g., 85° C.) of base 5 is lower than predetermined temperature T4 (e.g., 130° C.). If steam jets in this state, the steam is cooled by base 5, and dew condensation water is mixed in the steam to jet, and wets clothing or the like during ironing.

According to this exemplary embodiment, high-temperature steam generated by vaporizing chamber 6 flows into heating chamber 8 to heat heating chamber 8. The steam that has heated base 5 flows into second heating passage 14 formed on the upper surface side of heating body 4*a* to be heated again by heating body 4*a*, and thereafter jets from steam jet holes 10. Consequently, the steam heated again passes through heating chamber 8, so that base 5 is heated, and the temperature of base 5 increases from temperature T3 (e.g., 85° C.) to temperature T5 (e.g., 105° C.) in a short time, as illustrated in FIG. 7.

When passing through second heating passage 14, the steam after passing through heating chamber 8 to heat base 5 is heated again by high-temperature heating body 4*a*, thereafter is sent to base passage 9, and passes through steam jet holes 10 to jet. The steam to be jetted is heated again, so that the steam is brought into a more favorable state where dew condensation water is not contained.

Accordingly, the user does not need to wait until the temperature of base 5 increases to temperature T4 even right after a start of electrical conduction, and can iron, from the beginning, with steam in the favorable state where water droplets are not contained.

As described above, steam iron 1 according to this exemplary embodiment includes heating body 4*a* having heater 3, vaporizing chamber 6 that is formed on the upper surface side of heating body 4*a*, and generates steam, lid 7 for covering the upper surface side of heating body 4*a*, base 5 provided on the lower surface side of heating body 4*a*, steam jet holes 10 provided in base 5, and steam passage 12 for guiding the steam generated by vaporizing chamber 6 to steam jet holes 10.

Steam passage 12 has heating passages (first heating passage 13 and second heating passage 14) formed on the upper surface side of heating body 4*a*, and heating chamber 8 and base passage 9 formed on the lower surface side of heating body 4*a*, and the steam after passing through heating chamber 8 is guided to base passage 9 via first heating passage 13 and second heating passage 14 to jet from steam jet holes 10.

According to this exemplary embodiment, the steam generated by vaporizing chamber 6 heats base 5 when passing through heating chamber 8. Therefore, the temperature of base 5 increases in a short time, thereby preventing generation of dew condensation. As a result, even in a case where base 5 is set to a low temperature, it is possible to iron with steam in a favorable state where water droplets are not contained.

In steam iron 1 according to this exemplary embodiment, heating chamber 8 is formed by heating body 4*a* and base 5, and is provided below vaporizing chamber 6. According to this exemplary embodiment, when passing through heating chamber 8, the steam is heated by high-temperature vaporizing chamber 6, and therefore a temperature reduction of the steam can be suppressed.

In steam iron 1 according to this exemplary embodiment, heating chamber 8 is formed to be elongated in a longitudinal direction of base 5. According to this exemplary embodiment, heating chamber 8 heats base 5 in a wider range, and therefore heating of base 5 is promoted.

In steam iron 1 according to this exemplary embodiment, base passage 9 is provided along an outer periphery of heating chamber 8. According to this exemplary embodiment, steam jet holes 10 can be dispersedly provided in a wide range of base 5, and a wrinkle smoothing effect can be enhanced.

In steam iron 1 according to this exemplary embodiment, the heating passages (first heating passage 13 and second heating passage 14) have a three-dimensional layered structure along heating body 4*a* by partitioning plates (first partitioning plate 15 and second partitioning plate 16) provided between heating body 4*a* and lid 7. According to this exemplary embodiment, longer steam passage 12 along heating body 4*a* is formed in a limited space. Consequently, vaporization is promoted.

In steam iron 1 according to this exemplary embodiment, the heating passages (first heating passage 13 and second heating passage 14) have first partitioning plate 15 and second partitioning plate 16 between heating body 4*a* and lid 7. First partitioning plate 15 is provided with first partitioned passage 13*a* for guiding the steam from vaporizing chamber 6 to heating chamber 8. Second partitioning plate 16 is provided with second partitioned passage 14*a* for guiding the steam from heating chamber 8 to base passage 9. According to this exemplary embodiment, longer steam passage 12 along heating body 4*a* is formed in a limited space. Consequently, vaporization is promoted.

In steam iron 1 according to this exemplary embodiment, base 5 and heating body 4*a* are sealed with first sealing part 17 provided along an outer periphery of base passage 9, and second sealing part 18 provided along an inner periphery of base passage 9.

According to this exemplary embodiment, it is possible to reliably prevent leakage of steam or water droplets. Furthermore, heat conduction from heating body 4*a* to base 5 is absorbed, and base 5 can be set to a low temperature even when heating body 4*a* is set to a high temperature suitable for vaporization.

In steam iron 1 according to this exemplary embodiment, heater 3 has the substantially U-shaped curved part, and vaporizing chamber 6 is formed on an inside and an outside of curved part 3*a*. According to this exemplary embodiment, a part, having large heat capacity, of heater 3 can efficiently heat vaporizing chamber 6 to enhance vaporization capability, and a large amount of steam can be efficiently generated.

(Modification)

Figure 8:
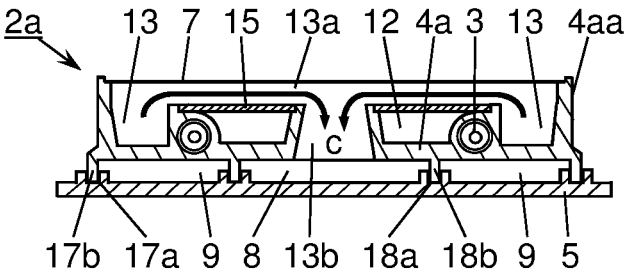
FIG. 8 is a transverse sectional view of a base part according to a modification of the first exemplary embodiment.

FIG. 8 is a transverse sectional view of base part 2*a* of steam iron 1 according to a modification of this exemplary embodiment, base part 2*a* being located at a position similar to that in FIG. 5.

In this modification, lid 7 is formed of a thin plate. Other configurations are basically the same as the above configurations, and therefore the same or corresponding parts are denoted by the same reference numerals, and a detailed description is omitted.

As illustrated in FIG. 8, heating body 4*a* has side wall 4*aa* higher than the partitioning plates (first partitioning plate 15 and second partitioning plate 16). Lid 7 is formed by punching of a thin plate made of good heat conductive aluminum. Lid 7 covers an upper surface of heating body 4*a* including vaporizing chamber 6 and heating passages (first heating passage 13 and second heating passage 14), and is seal-bonded to side wall 4*aa* of heating body 4*a*. By this configuration, processing of lid 7 and manufacturing of heating body 4*a* are facilitated.

Second Exemplary Embodiment

Hereinafter, steam iron 1 according to a second exemplary embodiment of the present disclosure is described. In this exemplary embodiment, parts identical with or corresponding to the parts of the first exemplary embodiment are denoted by the same reference numerals, and overlapping descriptions are omitted.

Figure 9:
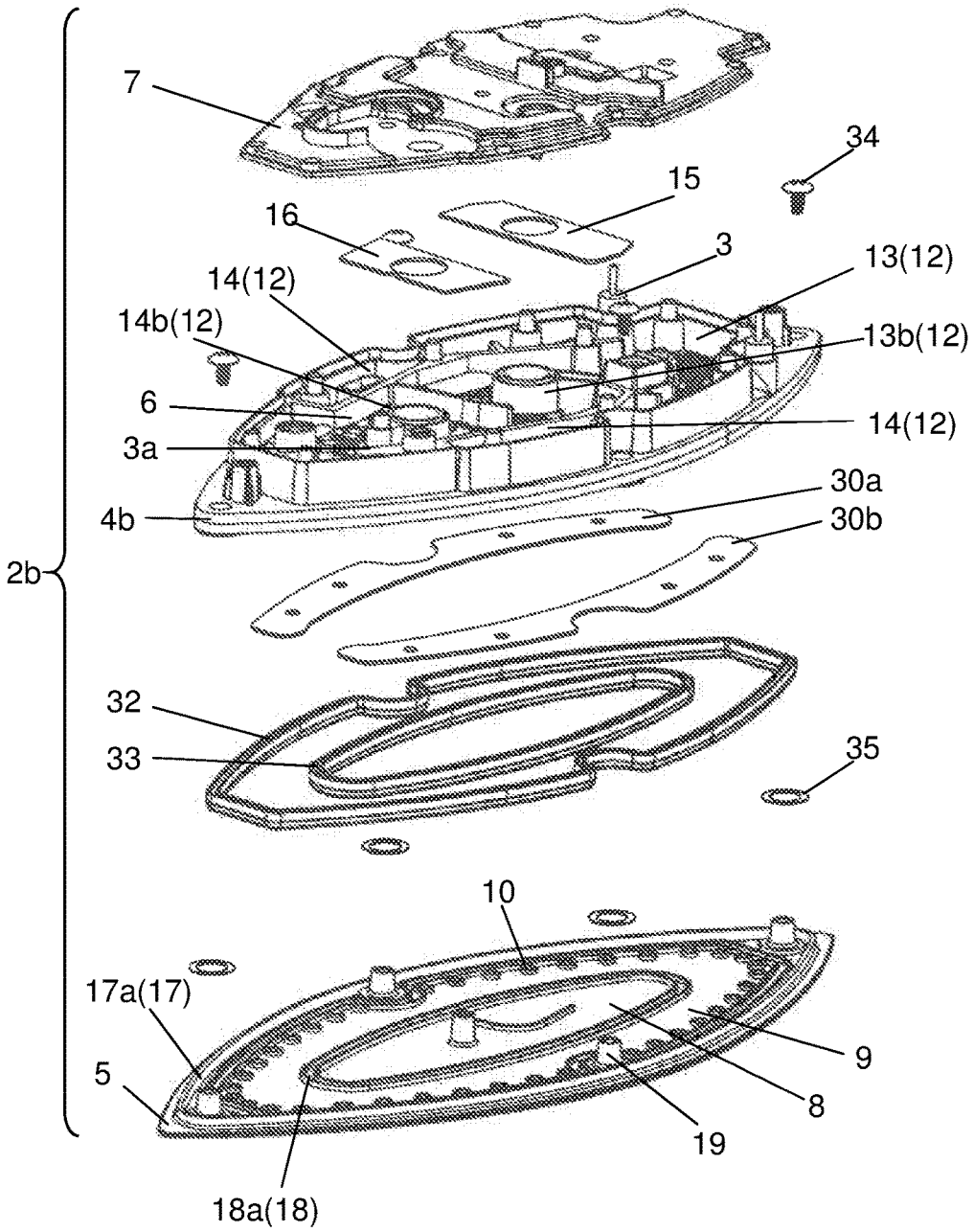
FIG. 9 is an exploded perspective view of a case where a base part according to a second exemplary embodiment of the present disclosure is obliquely viewed from above.
Figure 10:
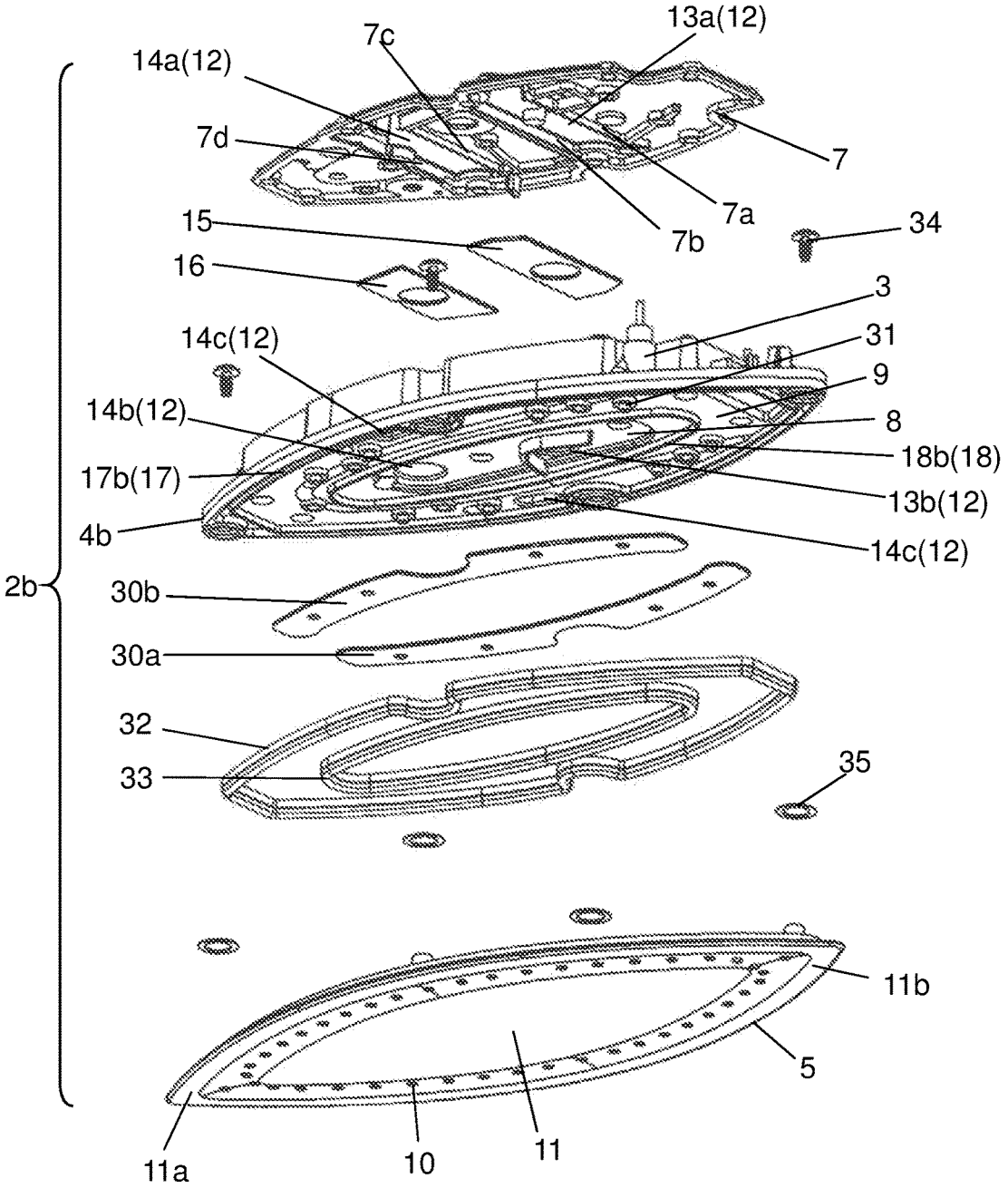
FIG. 10 is an exploded perspective view of a case where the base part according to the second exemplary embodiment is obliquely viewed from below.

FIG. 9 is an exploded perspective view of a case where base part 2*b* of steam iron 1 according to the second exemplary embodiment of the present disclosure is obliquely viewed from above. FIG. 10 is an exploded perspective view of a case where base part 2*b* is obliquely viewed from below.

As illustrated in FIG. 9 and FIG. 10, in base passage 9, auxiliary heating plate 30*a* and auxiliary heating plate 30*b* that extend from a vicinity of a front part of base passage 9 to a vicinity of a back part thereof are provided. Base 5 and heating body 4*b* are fastened by screws 34 with heat insulation rings 35 interposed therebetween. Heat insulation rings 35 suppress heat conduction between base 5 and heating body 4*b*.

Packing 32 is formed of silicon rubber, and is disposed in first sealing part 17 to seal a space between groove 17*a* and protrusion 17*b*. Similarly, packing 33 is formed of silicon rubber, and is disposed in second sealing part 18 to seal a space between groove 18*a* and protrusion 18*b*.

Figure 11A:
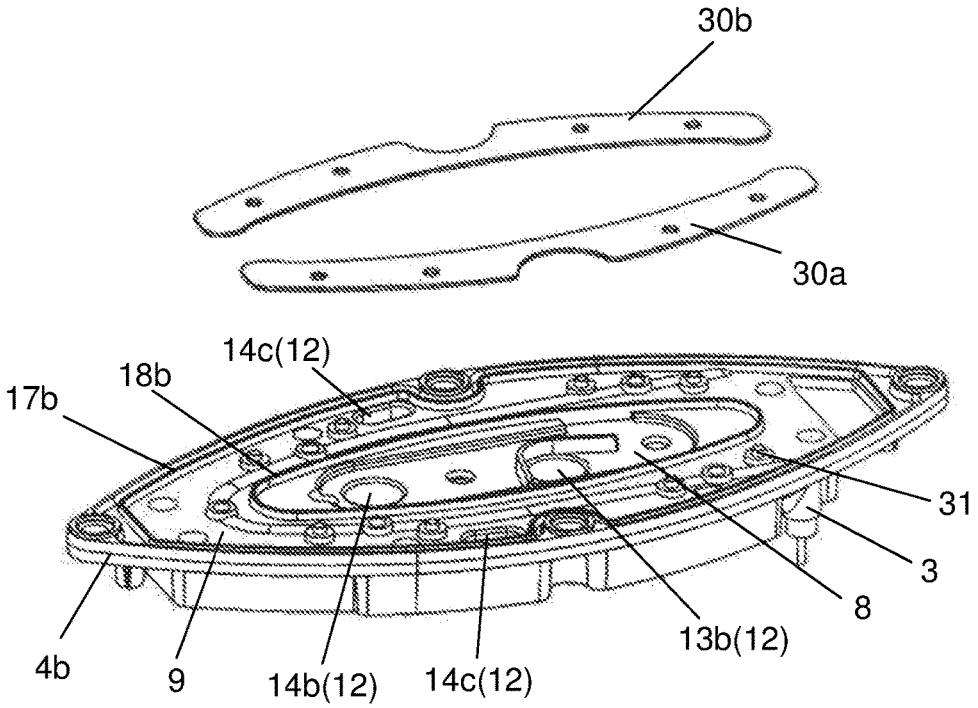
FIG. 11A is a diagram illustrating a state before mounting of auxiliary heating plates on a back side of a heating body according to the second exemplary embodiment.
Figure 11B:
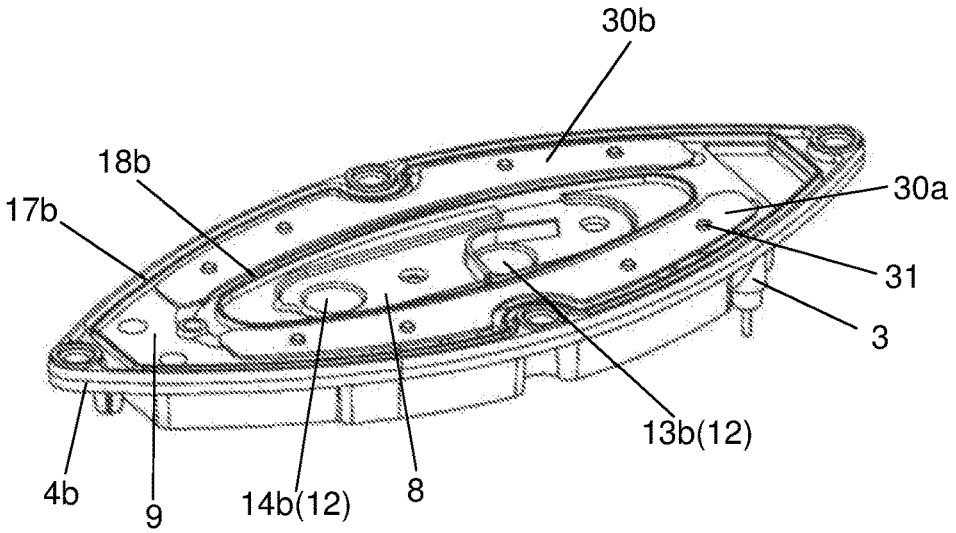
FIG. 11B is a diagram illustrating a state after mounting of the auxiliary heating plates on the back side of the heating body according to the second exemplary embodiment.

FIG. 11A is a diagram illustrating a state before mounting of auxiliary heating plates 30*a* and 30*b* on a back side of heating body 4*b*. FIG. 11B is a diagram illustrating a state after mounting of auxiliary heating plates 30*a* and 30*b* on the back side of heating body 4*b*.

As illustrated in FIG. 11A and FIG. 11B, pedestal 31 is integrally formed with heating body 4*b* on a lower surface, facing base passage 9, of heating body 4*b*. Auxiliary heating plates 30*a* and 30*b* are mounted on pedestal 31 so as to face communication hole 14*c*. In this state, auxiliary heating plates 30*a* and 30*b* are thermally connected to heating body 4*b* through pedestal 31.

Figure 12:
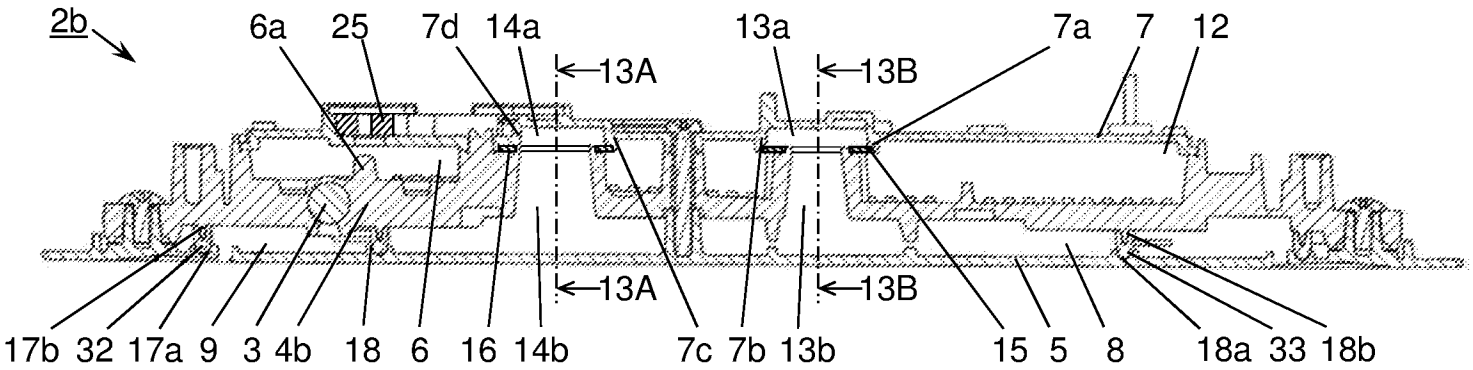
FIG. 12 is a longitudinal sectional view of a principal part of a central part of the base part according to the second exemplary embodiment.
Figure 13A:
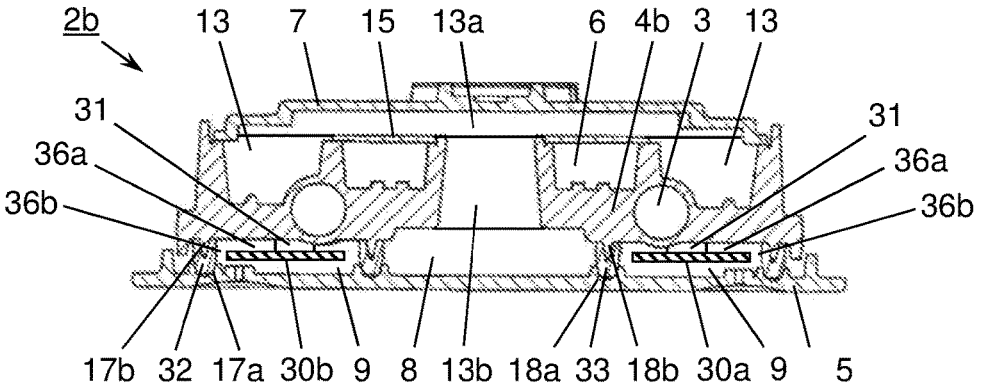
FIG. 13A is a sectional view taken along line 13A-13A in FIG. 12.

FIG. 12 is a longitudinal sectional view of a principal part of a central part of base part 2*b*. FIG. 13A is a sectional view taken along line 13A-13A in FIG. 12, and FIG. 13B is a sectional view taken along line 13B-13B in FIG. 12.

Figure 13B:
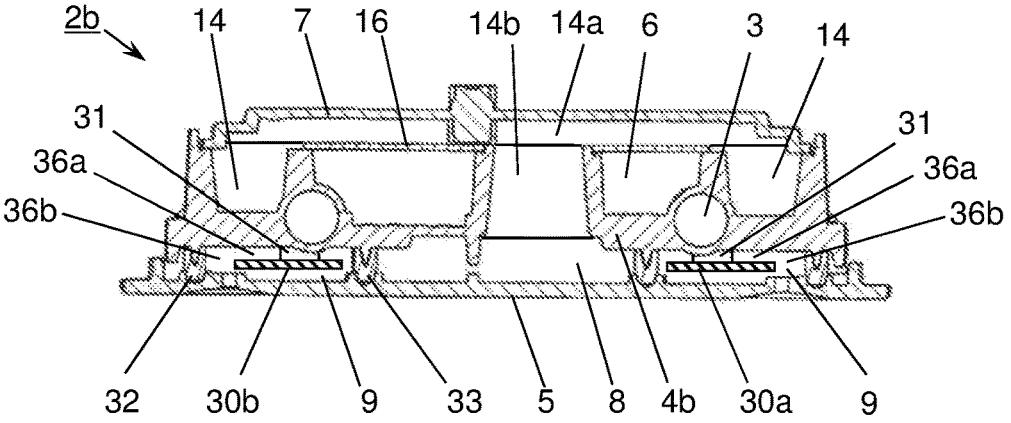
FIG. 13B is a sectional view taken along line 13B-13B in FIG. 12.

As illustrated in FIG. 13A and FIG. 13B, clearances 36*a* are provided between the lower surface of heating body 4*b* and auxiliary heating plates 30*a* and 30*b*, and clearances 36*b* are provided between a side wall of base passage 9 and auxiliary heating plates 30*a* and 30*b*.

Operation and action of steam iron 1 configured as described above are hereinafter described.

In a case of ironing in a steam-ironing mode, similarly to the first exemplary embodiment, steam generated by vaporizing chamber 6 passes through communication hole 14*c* via steam passage 12.

A part of steam after passing through communication hole 14*c* flows into a lower side of auxiliary heating plates 30*a* and 30*b* of base passage 9 via clearances 36*a* and clearances 36*b*, and jets outside ironing surface 11 from steam jet holes 10 (see FIG. 10).

Remaining steam after passing through communication hole 14*c* flows in clearances 36*a* forward and backward, reaches the front part and the back part of base passage 9, and jets outside ironing surface 11 from steam jet holes 10 provided in front part 11*a* and back part 11*b* of ironing surface 11 (see FIG. 10).

When steam iron 1 is used, auxiliary heating plates 30*a* and 30*b* are located below communication hole 14*c*, and heated by heating body 4*b*. Therefore, even when steam containing dew condensation water is jetted from communication hole 14*c* for some reason or other, the dew condensation water is received by auxiliary heating plates 30*a* and 30*b*, and is heated to be vaporized again.

As described above, steam iron 1 according to this exemplary embodiment includes auxiliary heating plates 30*a* and 30*b* provided in base passage 9, located below communication hole 14*c* being a third communicating part during use of steam iron 1, and thermally connected to heating body 4*b*.

According to this exemplary embodiment, it is possible to further suppress a possibility that dew condensation water is mixed in the steam jetted from steam jet holes 10. As a result, it is possible to iron with steam in a favorable state where water droplets are not contained even in a case where base 5 is set to a low temperature.

INDUSTRIAL APPLICABILITY

As described above, the present disclosure is applicable to steam irons for household use and professional use.

REFERENCE MARKS IN THE DRAWINGS

1 steam iron
2*a*, 2*b* base part
3 heater
4*a*, 4*b* heating body
4*aa* side wall
5 base
6 vaporizing chamber
6*a* dropping part
7 lid
7*a*, 7*b*, 7*c*, 7*d* ledge
8 heating chamber
9 base passage
10 steam jet holes
11 ironing surface
11*a* front part
11*b* back part
12 steam passage
13 first heating passage
13*a* first partitioned passage
13*b* first communicating part
14 second heating passage
14*a* second partitioned passage
14*b* second communicating part
14*c* communication hole
15 first partitioning plate
16 second partitioning plate
17 first sealing part
18 second sealing part
17*a*, 18*a* groove
17*b*, 18*b* protrusion
18*c* seal material
19 fixing parts
20 heat insulator
21 handle
22 grip
23 water tank
23*a* water injection port lid
24 nozzle
25 nozzle packing
26 openable rod
27 operation button
28 thermostat
29 power switch
30*a*, 30*b* auxiliary heating plate
31 pedestal
32, 33 packing
34 screws
35 heat insulation rings
36*a*, 36*b* clearances

What is claimed is:

1. A steam iron comprising:
a heating body having a heater;
a vaporizing chamber provided on an upper surface side of the heating body for generating steam;
a lid for covering the upper surface side of the heating body;
a base provided on a lower surface side of the heating body;
a steam jet hole provided in the base; and
a steam passage for guiding the steam generated by the vaporizing chamber to the steam jet hole,
wherein the steam passage has a heating passage provided on the upper surface side of the heating body, and a heating chamber and a base passage which are provided on the lower surface side of the heating body, and the steam passage is configured to guide the steam after passing through the heating chamber, to the base passage via the heating passage so that the steam is jetted from the steam jet hole,
the heating chamber is provided between the heating body and the base, and is provided below the vaporizing chamber,
the heating chamber has an elongated shape in a longitudinal direction of the base, and
the base passage is provided along an outer periphery of the heating chamber.

2. The steam iron according to claim 1, further comprising a partitioning plate provided between the heating body and the lid, wherein
the heating passage has a partitioned passage provided along the partitioning plate, and a communicating part that vertically penetrates the heating body.

3. The steam iron according to claim 2, further comprising a first partitioning plate and a second partitioning plate provided between the heating body and the lid, wherein
the partitioned passage has a first partitioned passage provided along the first partitioning plate, and a second partitioned passage provided along the second partitioning plate, and
the communicating part has a first communicating part that communicates the first partitioned passage with the heating chamber, a second communicating part that communicates the heating chamber with the second partitioned passage, and a third communicating part that communicates the second partitioned passage with the base passage.

4. The steam iron according to claim 1, wherein the base and the heating body are seal-bonded with at least a first sealing part provided along an outer periphery of the base passage, and a second sealing part provided along an inner periphery of the base passage.

5. The steam iron according to claim 1, wherein the heater has a substantially U-shaped curved part, and the vaporizing chamber is provided on an inside and an outside of the curved part.

6. The steam iron according to claim 1, wherein the lid is formed of a thin plate.

7. The steam iron according to claim 3, further comprising an auxiliary heating plate provided in the base passage and below the third communicating part, the auxiliary heating plate thermally connected to the heating body.

* * * * *